US007216700B2

(12) United States Patent
Roberts

(10) Patent No.: US 7,216,700 B2
(45) Date of Patent: May 15, 2007

(54) TORSIONAL RESISTANT SLIP MECHANISM AND METHOD

(75) Inventor: William M. Roberts, Tomball, TX (US)

(73) Assignee: Smith International, Inc., Houston, TX (US)

( * ) Notice: Subject to any disclaimer, the term of this patent is extended or adjusted under 35 U.S.C. 154(b) by 289 days.

(21) Appl. No.: 10/245,184

(22) Filed: Sep. 17, 2002

(65) Prior Publication Data

US 2003/0150607 A1 Aug. 14, 2003

Related U.S. Application Data

(60) Provisional application No. 60/322,617, filed on Sep. 17, 2001.

(51) Int. Cl.
*E21B 23/01* (2006.01)

(52) U.S. Cl. ..... 166/134; 166/382; 175/230

(58) Field of Classification Search ..... 175/423, 175/76, 203, 230, 256; 166/382, 138, 118, 166/119, 120, 134, 117.6
See application file for complete search history.

(56) References Cited

U.S. PATENT DOCUMENTS 1,834,316 A * 12/1931 McLagan ..... 294/102.2
2,010,938 A * 8/1935 Abegg ..... 175/423
2,119,731 A * 6/1938 Abegg ..... 175/423
2,143,615 A * 1/1939 Abegg ..... 175/423
2,290,799 A * 7/1942 Brauer ..... 175/423
2,520,448 A * 8/1950 Abegg ..... 24/455
2,552,618 A * 5/1951 Boatright ..... 175/423
2,814,087 A * 11/1957 Palmer ..... 175/423
3,638,723 A 2/1972 Carroll
3,736,984 A 6/1973 Garrett
4,285,399 A 8/1981 Holland et al.
4,304,299 A 12/1981 Holland et al.
4,349,071 A 9/1982 Fish
5,048,613 A 9/1991 Shilling
5,129,453 A 7/1992 Greenlee
5,154,231 A 10/1992 Bailey et al.
5,194,859 A 3/1993 Warren
5,210,533 A 5/1993 Summers et al.
5,398,754 A 3/1995 Dinhoble
5,409,060 A 4/1995 Carter
5,437,340 A * 8/1995 Lee et al. ..... 175/61
5,454,430 A 10/1995 Kennedy et al.
5,488,989 A 2/1996 Lesing et al.
5,540,279 A * 7/1996 Branch et al. ..... 166/118
5,560,426 A 10/1996 Trahan et al.
5,564,503 A 10/1996 Longbottom et al.
5,579,829 A 12/1996 Comeau et al.
5,704,437 A 1/1998 Murray
5,735,350 A 4/1998 Longbottom et al.
5,740,864 A 4/1998 De Hoedt et al.
5,775,428 A 7/1998 Davis et al.
5,839,515 A 11/1998 Yuan et al.
5,871,046 A 2/1999 Robison
5,957,209 A 9/1999 Burleson et al.

(Continued)

*Primary Examiner*—David Bagnell
*Assistant Examiner*—Daniel P Stephenson

(57) ABSTRACT

A well bore tool with a torsional resistant slip mechanism for resisting axial and torsional forces comprising a mandrel, a plurality of slips disposed about the circumference of the mandrel. The slips include a plurality of inserts oriented to resist axial forces and torsional forces. The tool also comprises a setting means adjacent each to slip for radially expanding and setting said slips.

17 Claims, 2 Drawing Sheets

U.S. PATENT DOCUMENTS 5,992,523 A 11/1999 Burleson et al.
6,019,173 A 2/2000 Saurer et al.
6,112,811 A 9/2000 Kilgore et al.
6,164,377 A 12/2000 Roberts
6,305,474 B1 10/2001 Roberts et al.
6,554,062 B1 * 4/2003 Dewey et al. ..... 166/50
6,564,871 B1 * 5/2003 Roberts ..... 166/313
6,571,867 B2 * 6/2003 Bond ..... 166/50
6,688,399 B2 * 2/2004 Maguire et al. ..... 166/382
6,966,386 B2 * 11/2005 Ringgenberg et al. ..... 166/387
6,976,534 B2 * 12/2005 Sutton et al. ..... 166/134

* cited by examiner

TORSIONAL RESISTANT SLIP MECHANISM AND METHOD

CROSS-REFERENCE TO RELATED APPLICATIONS

This application claims priority to Provisional Application Ser. No. 60/322,617 filed on Sep. 17, 2001 in the name of William Roberts as inventor.

STATEMENT REGARDING FEDERALLY SPONSORED RESEARCH OR DEVELOPMENT

Not applicable.

BACKGROUND OF THE INVENTION

1. Field of the Invention

This invention relates to a slip mechanism in anchors or packers used in the oil and gas industry, and more particularly to a mechanically set retrievable packer with a torsional resistant slip mechanism. The disclosure of U.S. patent application Ser. Nos. 09/302,738, now U.S. Pat. No. 6,164,377 issued Dec. 26, 2000, and 09/302,982, now U.S. Pat. No. 6,305,474, are incorporated herein by reference.

2. Background of the Invention

It is often desirable to sidetrack or deviate from an existing well borehole for various reasons. For instance, when a well bore becomes unusable, a new bore hole may be drilled in the vicinity of the existing cased bore hole or alternatively, a new bore hole may be sidetracked from the serviceable portion of the cased well bore. Such sidetracking from a cased borehole may also be useful for developing multiple production zones. This drilling procedure can be accomplished by milling through the side of the casing with a mill that is guided by a wedge or whipstock component. It is well known in the industry that whipstocks are used to sidetrack drill bits or mills at an angle from a borehole. The borehole may be lined with pipe casing or uncased. More often than not, the previous borehole is cased.

To complete a sidetracking operation, a typical down hole assembly consists of a whipstock attached to some form of packer or anchor mechanism that holds the whipstock in place once the whipstock has been set at the desired location and angle orientation. The upper end of a whipstock comprises an inclined face. Once the whipstock is properly set and aligned, as a mill is lowered, the inclined face guides the mill laterally with respect to the casing axis. The mill travels along the face of the whipstock to mill a window and/or to create the deviated borehole.

Mechanically set anchors typically utilized to support whipstocks have one or more slips which engage the casing or borehole. Often, the holding capabilities of these conventional devices are not enough to prevent slippage or movement during sidetracking operations. It has been found that conventional whipstock supports may be susceptible to small, but not insignificant amounts of rotational movement. If a misalignment were to occur during a window milling operation, the mill could become stuck in the hole resulting in a difficult and expensive fishing operation. Another unintended result could be that a lateral well bore is drilled in the wrong direction.

Typical slip mechanisms provide minimal upward loading capability and very little torque resistant capacity. These traditional slip mechanisms use wickers or grooves machined into the outer surface of the slip to grip the well bore and resist torsional and longitudinal (axial) forces.

These gripping mechanisms allowed for very limited penetration into the casing or borehole, and therefor were prone to unwanted movement. These known problems with tools in the prior art demand that drillers limit the amounts of force applied during such milling and drilling operations. This results in lower rates of penetration, and ultimately, a more costly well.

Hence, it is desired to provide an anchor and whipstock setting apparatus that effectively resists torsional forces and prevents a whipstock from rotating. It is a further desire to provide an effective whipstock support that can be run into a borehole and set using conventional wireline methods.

Other objects, features and advantages of the invention will be apparent from the following detailed description taken in connection with the accompanying drawings.

BRIEF SUMMARY OF THE INVENTION

The present invention provides a wellbore anchoring tool with a torsional resistant slip mechanism that effectively resists both axial and rotational forces. According to the preferred embodiment, the present tool includes a mandrel, a plurality of slips disposed about the circumference of the mandrel. The slips include a first set of inserts oriented to resist axial forces and a second set of inserts oriented to resist rotational forces. The present invention further provides a setting means adjacent each slip for radially expanding and setting said slips, so as to resist rotation about the tool axis when the slips engage the casing.

BRIEF DESCRIPTION OF THE DRAWINGS

For a detailed description of the preferred embodiments of the invention, reference will now be made to the accompanying drawings in which: The present invention will be more fully understood by reference to the following figures illustrating the preferred embodiment of the present invention.

NOTATION AND NOMENCLATURE

Figure 1:
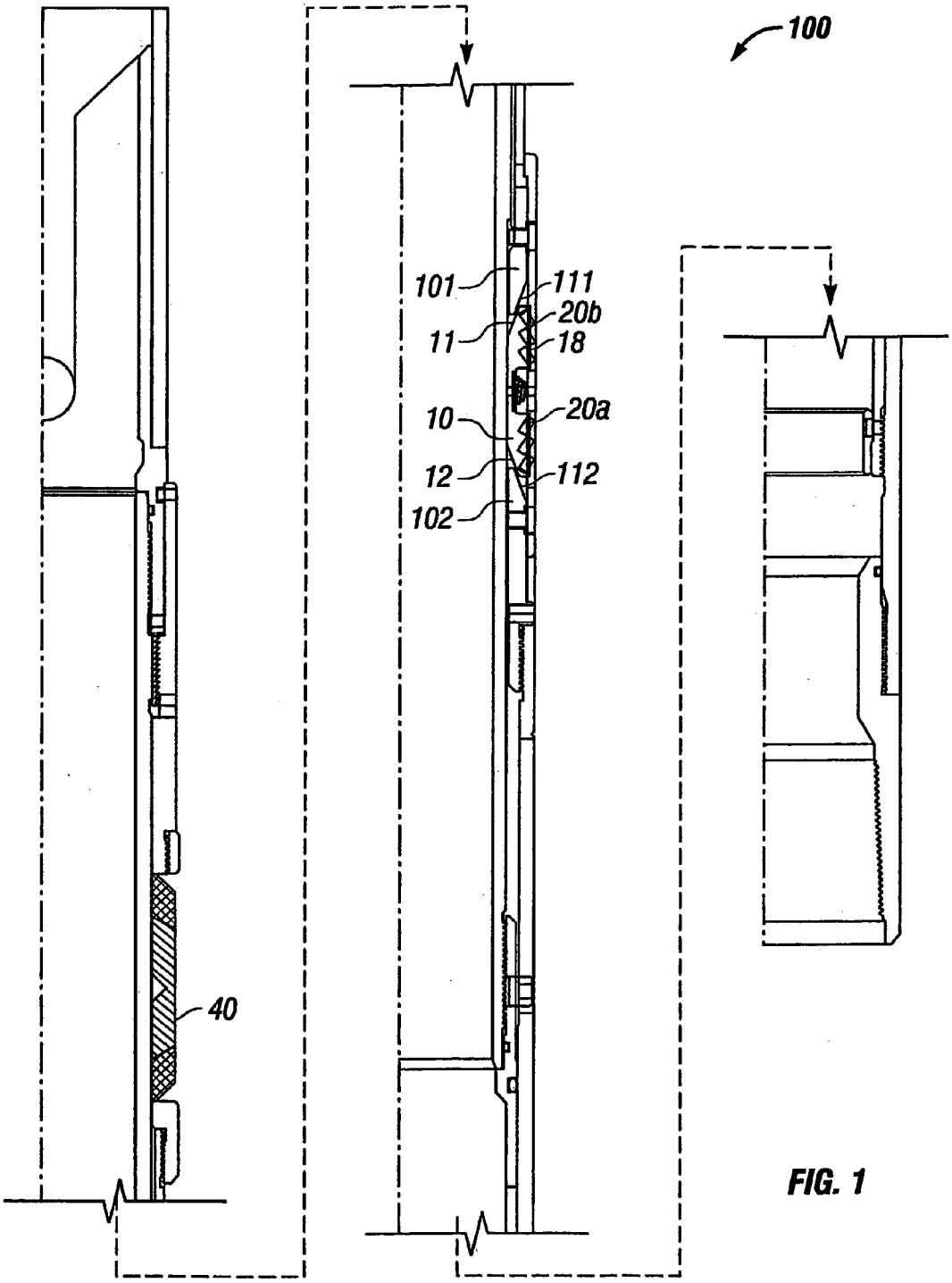
FIG. 1 is a quarter section view of the preferred embodiment of a packer with the torsional resistant slip mechanism of the present invention.

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . .".

The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different constructions and methods of operation. It is to be fully recognized that the different teachings of the embodiments discussed below may be employed separately or in any suitable combination to produce desired results. Reference to up or down will be made for purposes of description with "up" or "upper" meaning toward the surface of the well and "down" or "lower" meaning toward the bottom of the primary wellbore or lateral borehole.

DESCRIPTION OF THE PREFERRED EMBODIMENTS

Referring to FIGS. 1*a*–1*g* there is shown a side view of a wireline set retrievable whipstock seal bore packer with the torsional resistant slips mechanism of the present invention. Tool 100 has an upper cone 101 and a lower cone 102. Each slip 10 includes an upper and lower slip camming surface 11, 12. A packer assembly 40 is disposed above the slip and cone mechanisms.

The upper cone 101 preferably includes an upper camming surface 111 to engage lower slip camming surface 11. The lower cone 102 is disposed below the slip 10 and has a camming surface 112 to engage lower slip camming surface 12. In the preferred embodiment, the camming surfaces of the cones and slips are flat surfaces, resulting in uniform forces applied between these members. Slips known in the prior art had conical shaped back surfaces; thus, contact between those cones and slips resulted in an undesirable bending moment. No bending moments result from the contact between the flat camming surfaces of the cones and slips of the present invention. The above description of setting the slips is the preferred method of this invention; however, other methods of radially extending and setting the slips are well known by those skilled in the arts. Any such method may be practiced without departing from the spirit and scope of this invention.

Figure 2:
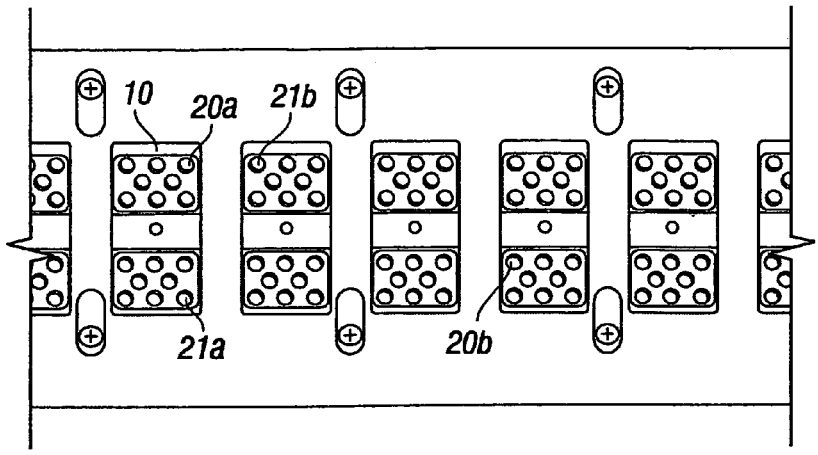
FIG. 2 is a circumferential plane view of the torsional resistant slip mechanisms of the present invention.

Referring to FIG. 2, the slips 10 in the preferred embodiment of the wellbore tool comprise a first and second set of carbide inserts 20, 21 on the outer surface 18 of the slips. A first set of inserts 20 is oriented so that they most effectively resist axial forces. Inserts 20 preferably comprise generally cylindrical disks that are mounted with their axes inclined with respect to the tool axis and their faces oriented upward or downward and radially outward to resist axial forces.

As best shown in FIGS. 1*d* and 2, the inserts are inclined with respect to the tool axis and their faces oriented upward or downward and radially outward. The smaller surface area of the insert when so oriented allows for greater penetration into the casing inner wall and thereby improves the resistance to any movement once the slips 10 are set. Wickers milled on slips, as is common in the prior art, are known to penetrate the casing by approximately 0.030". In contrast, inserts configured as in the present invention can penetrate the casing by more that 0.096". Increased penetration allows the inserts to better resist axial and torsional loads.

A second set of inserts 21 is also likewise oriented and then rotated 90 degrees in a transverse plane. Thus, the second set of inserts 21 is configured to most effectively resist torsional forces. As will be readily recognized by one skilled in the art, degrees of rotation between the first set of inserts 20 and the second set of inserts 21 need not be 90 degrees and may vary without departing from the spirit of the inventions. However, in the preferred embodiment of this invention, the first and second set of inserts 20, 21 are rotated by at least 45 degrees in a transverse plane. In the most preferred embodiment, the inserts are rotated about 90 degrees in a transverse plane.

In the embodiment illustrated in FIG. 2, the first set of inserts 20 are configured to resist both upward and downward axial forces. Inserts 20*a* are inclined with respect to the tool axis and their faces oriented upward and radially outward such that they are most resistant to upward axial forces. The faces of inserts 20*b* are oriented downward such that they are most resistant to downward axial forces.

Similarly, the second set of inserts 21 is configured to resist both clockwise and counterclockwise torsional forces. Inserts 21*a* are oriented such that they best resist clockwise rotational forces. Inserts 21*b* are oriented such that they best resist counterclockwise torsional forces.

In the preferred embodiment, the inserts are carbide discs; however, one skilled in the art will recognize that the inserts may be constructed from a variety of materials, including tungsten carbide, diamond, or carbonized steel. In the preferred embodiment, the inserts may be constructed of any material that is harder than the material used in common casing so that the inserts can easily bite into the casing wall.

As is also shown in FIG. 2, the inserts 20 are inserts that are generally cylindrical in shape. While a preferred configuration for the inserts is shown, it will be understood that any insert shape can be used. One skilled in the art will recognize that inserts of other geometric shapes, such are cubes, triangular or rectangular shapes may also be used as the insert of the rotational resistant slip mechanism.

Figure 3:
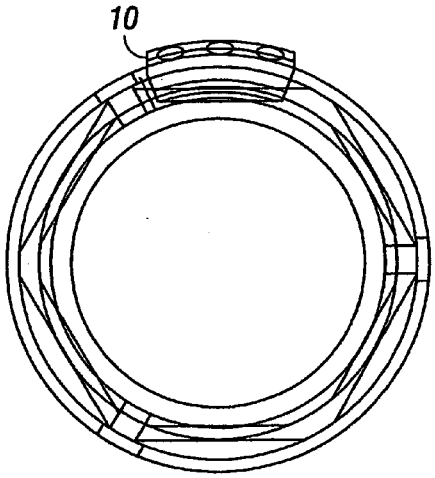
FIG. 3 is a top cross section view of the tool wherein one slip is shown in an engaged position.
Figure 4:
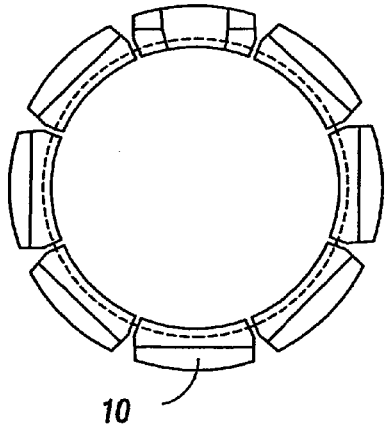
FIG. 4 is a top cross section view of an embodiment of the invention comprising eight slips.

As shown in FIG. 3, one preferred embodiment of a tool utilizing the rotational resistant slip mechanism comprises six slip mechanisms arranged at 60 degree intervals on the tool so as to create a "full circle" of slip members 10. The under faces of the slips are keyed to the remaining parts of the tool. Alternative embodiments may include various numbers of slips. For example, FIG. 4*a* shows an embodiment of the present invention where eight slips are utilized. However, it is preferred that regardless the number of slips, the slips are configured or otherwise sized to create a "full circle" around the tool mandrel.

The foregoing detailed description has been given for understanding only and no unnecessary limitations should be understood there from as some modifications will be obvious to those skilled in the art without departing from the scope and spirit of the apparatus.

The invention claimed is:

1. A well bore tool with a torsional resistant slip mechanism for resisting axial and torsional forces comprising:

a mandrel;

a plurality of slips disposed about the circumference of said mandrel, at least one of said slips having a first set of inserts oriented to resist axial forces and at least another of said slips having second set of inserts oriented to resist torsional forces, a setting means adjacent each slip for radially expanding and setting said slips; and wherein the inserts of said second set are rotated at least forty-five degrees in a transverse plane from the inserts of said first set.

2. The well bore tool according to claim 1 wherein the inserts of said second set are rotated at about ninety degrees in a transverse plane from the inserts of said first set.

3. The well bore tool according to claim 1 wherein said inserts are carbide inserts.

4. The well bore tool according to claim 1 wherein said inserts are cylindrical disks.

5. The well bore tool according to claim 1 wherein the inserts of said first set have an insert axis that is inclined with respect to the longitudinal axis of the well bore tool.

6. The well bore tool according to claim 1 wherein the inserts of said second set have an insert axis that is inclined with respect to a plane lying parallel to the longitudinal axis of the well bore tool and intersecting a radius of the well bore tool passing through the insert.

7. A well bore tool with a torsional resistant slip mechanism for resisting axial and torsional forces comprising:

a mandrel;

a plurality of slips disposed about the circumference of said mandrel, at least one of said slips having at least one insert oriented on said slip to resist torsional forces, a setting means adjacent each slip for radially expanding and setting said slips; and wherein said insert has an insert axis that is inclined with respect to a plane lying parallel to, and passing through, the longitudinal axis of the wellbore tool and intersecting a radius of the well bore tool passing through the insert.

8. The well bore tool according to claim 7 wherein said at least one slip further comprises at least one insert oriented to resist axial forces.

9. The well bore tool according to claim 8 wherein said inserts oriented to resist axial forces has an insert axis that is inclined with respect to the longitudinal axis of the well bore tool.

10. The well bore tool according to claim 7 wherein said inserts are cylindrical disks.

11. The well bore tool according to claim 7 wherein said inserts are carbide inserts.

12. A well bore tool with a torsional resistant slip mechanism for resisting axial and torsional forces comprising:

a mandrel;

a plurality of slips disposed about the circumference of said mandrel, at least one of said slips having a plurality of inserts wherein at least one insert is oriented to resist axial forces and at least one insert is oriented to resist torsional forces, a setting means adjacent each slip for radially expanding and setting said slips; and wherein said at least one insert oriented to resist axial forces is rotated at least forty-five degrees in a transverse plane from said at least one insert oriented to resist torsional forces.

13. The well bore tool according to claim 12 wherein said at least one insert oriented to resist axial forces is rotated about ninety degrees in a transverse plane from said at least one insert oriented to resist torsional forces.

14. The well bore tool according to claim 12 wherein said inserts are carbide inserts.

15. The well bore tool according to claim 12 wherein said inserts are cylindrical disks.

16. The well bore tool according to claim 12 wherein said at least one insert oriented to resist axial forces has an insert axis that is inclined with respect to the longitudinal axis of the well bore tool.

17. The well bore tool according to claim 12 wherein said at least one insert oriented to resist torsional forces has an insert axis that is inclined with respect to a plane lying parallel to the longitudinal axis of the well bore tool and intersecting a radius of the well bore tool passing through the insert.

* * * * *